US011598150B1

(12) United States Patent
Waller

(10) Patent No.: US 11,598,150 B1
(45) Date of Patent: Mar. 7, 2023

(54) LADDER-MOUNTED EQUIPMENT HOLDING ASSEMBLY AND METHOD

(71) Applicant: Ryan Douglas Waller, South Lake Tahoe, CA (US)

(72) Inventor: Ryan Douglas Waller, South Lake Tahoe, CA (US)

( * ) Notice: Subject to any disclaimer, the term of this patent is extended or adjusted under 35 U.S.C. 154(b) by 420 days.

(21) Appl. No.: 16/673,959

(22) Filed: Nov. 4, 2019

Related U.S. Application Data

(60) Provisional application No. 62/807,562, filed on Feb. 19, 2019, provisional application No. 62/755,271, filed on Nov. 2, 2018.

(51) Int. Cl.
*E06C 7/14* (2006.01)
*E06C 1/06* (2006.01)

(52) U.S. Cl.
CPC ..... *E06C 7/143* (2013.01); *E06C 1/06* (2013.01)

(58) Field of Classification Search
CPC ... E06C 7/143; E06C 7/14; E06C 7/00; E06C 7/165; E06C 7/086; E06C 7/083; E06C 7/183; E06C 1/06; E06C 1/12; E06C 7/50; E06C 7/087; E06C 7/06; E06C 7/08; E06C 1/10; E06C 9/06; F16B 7/04; F16B 7/0446; F16B 7/044; F16B 7/0413; F16B 7/042; F16B 7/187; F16B 2200/40; F16B 2200/20; F16B 2/18; F16B 2/185; F16B 9/02; B25B 27/02; E06B 13/0891
See application file for complete search history.

(56) References Cited

U.S. PATENT DOCUMENTS 3,160,383 A * 12/1964 Lamm ..... E06C 7/143 248/211
3,223,369 A * 12/1965 Benninger, Jr. ..... E06C 7/143 248/210
3,744,610 A * 7/1973 Tabler ..... F16B 7/0446 193/35 R
3,902,569 A * 9/1975 Bair ..... E06C 1/12 182/211
4,445,659 A * 5/1984 LaChance ..... E06C 7/143 182/120
4,523,733 A * 6/1985 Lunden, Jr. ..... E06C 7/143 248/210

(Continued)

*Primary Examiner* — Brian D Mattei
*Assistant Examiner* — Kathleen M. McFarland
(74) *Attorney, Agent, or Firm* — Michael D. Eisenberg

(57) ABSTRACT

A ladder-mounted equipment holding assembly and method for operating a ladder-mounted equipment holding assembly. The equipment holding assembly provides an elongated mount sleeve that is configured to slidably fit through the holes in the sides of a ladder, and receive a corresponding rung in the ladder. A pair of caps serve to centrally fasten the mount sleeve to the rung. The caps have clips that align with corresponding tracks formed in the mount sleeve. Interchangeable equipment anchoring accessories detachably attach to the free ends of the mount sleeve. The anchoring accessories comprise eclectic shapes and dimensions, such as threaded pipes, hooks, rings, and clips. The anchoring accessories serve to hold a corresponding equipment in an accessible position for a user working on the ladder. The equipment includes paint buckets, brushes, and tools pertinent to operations on ladder.

12 Claims, 12 Drawing Sheets

(56) References Cited

U.S. PATENT DOCUMENTS 4,662,594 A * 5/1987 Dubis ..... E06C 7/143 248/231.21
5,031,723 A * 7/1991 Hooten ..... E06C 1/38 182/120
5,191,954 A * 3/1993 Ledford ..... E06C 7/16 248/210
5,934,632 A * 8/1999 Weaver ..... E06C 7/143 248/210
5,950,762 A * 9/1999 George ..... A62C 31/28 248/77
5,960,905 A * 10/1999 Gardner ..... E06C 7/143 248/210
5,971,103 A * 10/1999 Mulvaney ..... E06C 7/143 248/238
6,269,907 B1 * 8/2001 Gillespie ..... E06C 7/143 248/210
6,352,135 B1 * 3/2002 Jones ..... E06C 7/143 182/120
6,766,990 B1 * 7/2004 Hileman ..... E06C 7/143 248/210
6,824,115 B1 * 11/2004 Batson ..... E06C 7/143 248/238
7,905,458 B2 * 3/2011 Hohensee ..... E06C 7/143 248/210
7,926,616 B2 * 4/2011 Gray ..... E06C 7/14 248/210
8,033,362 B1 * 10/2011 Cull ..... E06C 7/143 248/210
8,162,275 B2 * 4/2012 Reusser ..... E06C 7/143 248/210
8,919,713 B2 * 12/2014 Reusser ..... E06C 7/143 248/210
9,157,276 B2 * 10/2015 Saucier ..... E06C 7/143
9,644,425 B2 * 5/2017 Gordon ..... F16M 13/022
9,689,205 B2 * 6/2017 Saucier ..... F16B 2/04
9,732,558 B2 * 8/2017 Ayala ..... E06C 7/14
10,119,332 B1 * 11/2018 Schellens ..... E06C 7/14
10,501,989 B1 * 12/2019 McDonough ..... E06C 7/143
10,900,283 B1 * 1/2021 Sheets ..... E06C 7/16
11,168,520 B2 * 11/2021 Saylor ..... E06C 7/02
11,255,126 B1 * 2/2022 Adams ..... E06C 7/143
2002/0079413 A1 * 6/2002 Hileman ..... E06C 7/143 182/120
2003/0209387 A1 * 11/2003 Burr ..... E06C 7/14 182/129
2006/0131106 A1 * 6/2006 Adams ..... E06C 7/146 182/129
2006/0196999 A1 * 9/2006 Owens ..... E06C 7/143 248/210
2007/0221802 A1 * 9/2007 New, Sr. ..... E06C 7/143 248/210
2008/0035426 A1 * 2/2008 Leuthner ..... E06C 7/143 182/129
2010/0213003 A1 * 8/2010 Svehlek ..... A62B 35/0068 182/3
2010/0213008 A1 * 8/2010 Haenisch ..... E06C 7/086 182/129
2013/0140423 A1 * 6/2013 Taylor ..... E06C 7/143 248/210
2013/0192924 A1 * 8/2013 Paun ..... E06C 7/143 248/210
2013/0256481 A1 * 10/2013 Saucier ..... E06C 7/143 248/210
2015/0108302 A1 * 4/2015 Kahn ..... E06C 7/143 248/210
2017/0191312 A1 * 7/2017 Durbin, Jr. ..... E06C 7/143

* cited by examiner

LADDER-MOUNTED EQUIPMENT HOLDING ASSEMBLY AND METHOD

RELATED APPLICATIONS

This application claims priority from provisional application No. 62/755,271, which was filed on Nov. 2, 2018, and provisional application Ser. No. 62/807,562 filed Feb. 19, 2019 which are each hereby incorporated by reference their respective entirety.

TECHNICAL FIELD

The present invention relates generally to a ladder-mounted equipment holding assembly and method for operating a ladder-mounted equipment holding assembly. More so, the holding assembly detachably couples to a ladder to hold various types of equipment related to operations performed on the ladder. A ladder includes two parallel legs perpendicularly traversed by rungs that are fitted into spaced-apart holes forming along the length of the legs. The holding assembly includes a mount sleeve that fits into at least one of the sidewall holes, a pair of caps defined by pin holes and detachably coupled to the ends of the mount sleeve, a clip that engages with teeth or a locking pin that is registerable within a selected pin hole to secure the caps into the ends of the mount sleeve, and multiple interchangeable equipment anchoring accessories attachable to the ends of the mount sleeve and/or the caps, and configured to hold the equipment at the legs of the ladder.

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, ladders require a user to carry items up and down a ladder while climbing up and down the ladder. This process of carrying may require multiple trips up and back down the ladder for certain tasks and projects. Contractors and home owners are just a couple of the types of people who experience this issue. This is also a safety hazard as well and contributes to falls and injuries from using a ladder.

The present ladder-mounted equipment holding assembly attaches to the ladder rungs and allows a user to keep all necessary items attached to the ladder itself so that he doesn't have to go all the way back down the ladder to grab something. The ladder-mounted equipment holding assembly also allows a user to have his hands free while working, rather than having to hold the items at the top of the ladder or middle of the ladder with nowhere to safely store the items. The ladder-mounted equipment holding assembly is also adjustable so that it can attach securely to a ladder of any width.

Other proposals have involved equipment and tool holders directly on a ladder. The problem with these holding equipment and tools is that they do not accommodate eclectic types of equipment and tools, having different styles, shapes, and sizes. Also, the equipment is not held along the legs of the ladder for easy access. Even though the above cited equipment and tool holders directly on a ladder meet some of the needs of the market, a ladder-mounted equipment holding assembly that detachably couples to a ladder to hold eclectic types of equipment related to operations performed on the ladder, is still desired.

BRIEF SUMMARY OF THE INVENTION

Illustrative embodiments of the disclosure are generally directed to a ladder-mounted equipment holding assembly and method for operating a ladder-mounted equipment holding assembly. The ladder-mounted equipment holding assembly provides a hollow mount sleeve configured to slidably fit through the holes in the sides of a ladder, and receive a corresponding rung in the ladder. A pair of caps and a locking pin serve to centrally fasten the mount sleeve to the rung. Multiple interchangeable equipment anchoring accessories are detachably attachable to one of the free ends of the mount sleeve. The anchoring accessories comprise eclectic shapes and dimensions that serve to hold a corresponding equipment. The equipment may include containers and tools pertinent to operations on the ladder.

In one embodiment, the assembly has at least one mount sleeve defined by a channel, a pair of free ends, and a track disposed along the length of the mount sleeve. A pair of caps have a cavity, and are adapted to slidably fit to the free ends of the mount sleeve. The caps have a clip configured to engage with the track on the mount sleeve for fastening the caps to the free ends of the mount sleeve. The caps have a lock mechanism. Multiple interchangeable equipment anchoring accessories, each anchoring accessory are detachably attachable to one of the free ends of the mount sleeve via the lock mechanism.

In some embodiments, the ladder-mounted equipment holding assembly provides at least one mount sleeve defined by a channel, a pair of free ends, and a plurality of pin passageways disposed along the length of the mount sleeve.

In other embodiments, the assembly comprises a pair of caps defined by an open end, a closed end, and a cavity, the caps adapted to slidably fit to the free ends of the mount sleeve, the caps further being defined by multiple pin holes, whereby at least one of the pin holes aligns with the pin passageways when the bar sleeve is fitted to the free ends of the mount sleeve.

In other embodiments, the assembly comprises a locking pin being registerable within a selected pin passageway and pin hole for fastening the caps to the free ends of the mount sleeve.

In other embodiments, the assembly comprises multiple interchangeable equipment anchoring accessories, each anchoring accessory being detachably attachable to one of the free ends of the mount sleeve.

In a second aspect, the assembly is operable with a ladder, the ladder comprising an upper region and a lower region, the ladder further comprising two parallel legs defined by spaced-apart holes forming along the length of the legs, the ladder further comprising multiple rungs adapted to fit into the spaced-apart holes, the rungs disposed in a perpendicular arrangement relative to the legs.

In another aspect, the at least one of the rungs slidably receives the mount sleeve.

In another aspect, the mount sleeve is elongated.

In another aspect, the channel at the free ends of the mount sleeve is threaded.

In another aspect, a right free end of the mount sleeve is defined by more pin passageways than a left free end of the mount sleeve.

In another aspect, the mount sleeves and the caps comprise a hard-plastic material.

In another aspect, the caps are defined by a truncated cylinder shape.

In another aspect, the cavity of the caps slidably receives the free ends of the mount sleeve.

In another aspect, the locking pin comprises a ring, a cable, and at least one spring-loaded tab, the spring-loaded tab being operable to retain the locking pin in the pin passageways and the pin holes.

In another aspect, each anchoring accessory is detachably attachable to one of the caps, and one of the free ends of the mount sleeve.

In another aspect, the anchoring accessories include at least one of the following: a spring-loaded clip, a ring, a magnet, a cube, and an L-shaped pipe having a threaded free end.

In another aspect, the anchoring accessories comprise a flange terminating at a hook and a ring.

In another aspect, the anchoring accessories comprise a cylinder defined by a slot.

In another aspect, the anchoring accessories are operable to hold multiple equipment.

In another aspect, the equipment includes at least one of the following: a drill, tool, hammer, a scraper holder, a paint bucket, a caulk holster, a paint roller, a paper roll, a paint sprayer, a magnetic brush holder, and a window-washing bucket.

One objective of the present invention is to provide a ladder-mounted equipment holding assembly that is operable with a ladder, and various configurations of a ladder.

Another objective is to provide proximal access to equipment while working on a ladder.

Another objective is to provide anchoring accessories of different configurations to hold different types of equipment.

Another objective is to enable facilitated attachment of the assembly to any one of the rungs, so as to enable access to the equipment from multiple heights along the ladder.

Another objective is to provide a portable ladder-mounted equipment holding assembly that is operable with ladders.

Another objective is to provide an inexpensive to manufacture ladder-mounted equipment holding assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

DESCRIPTION OF THE PREFERRED EMBODIMENTS

Figure 1:
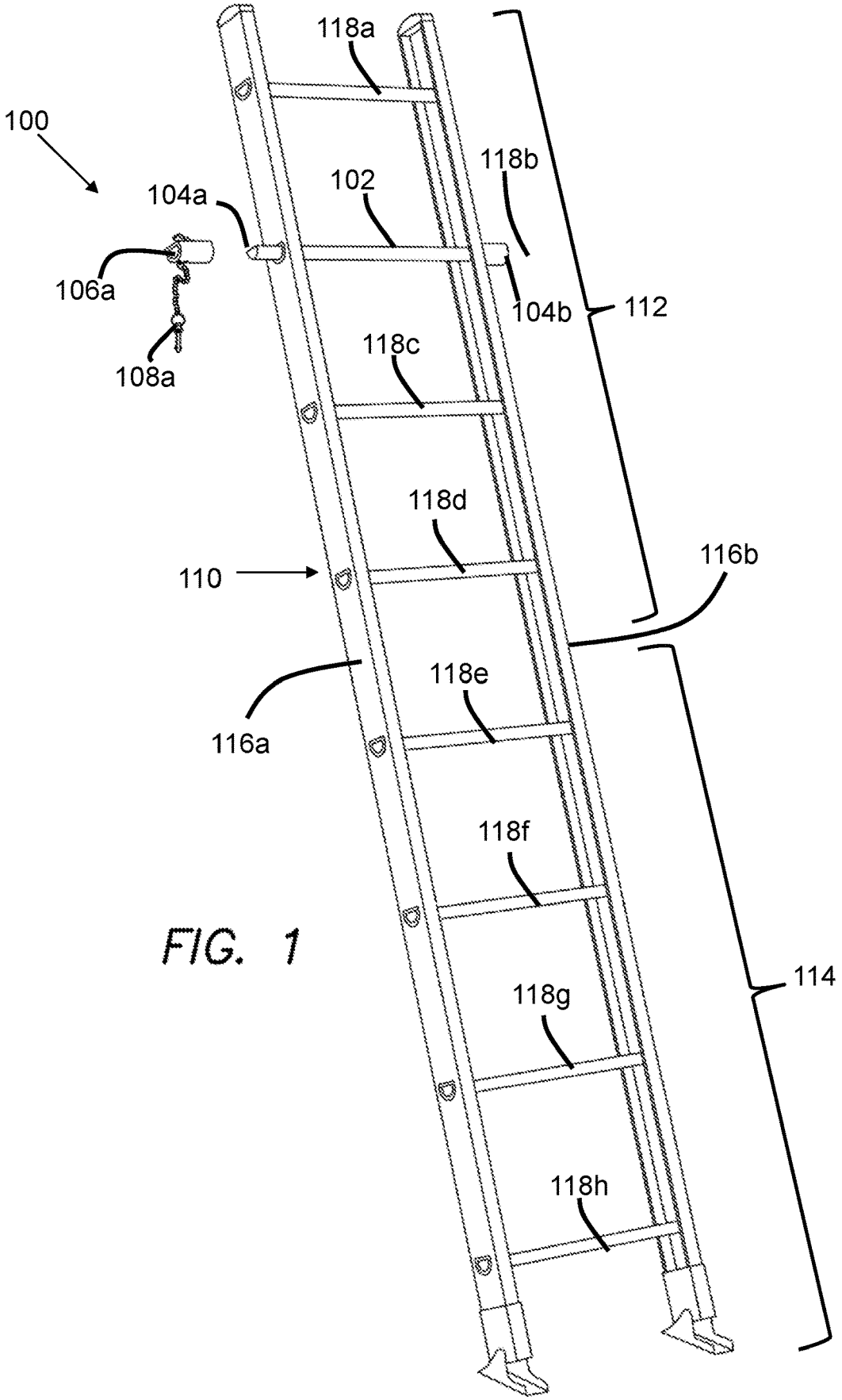
FIG. 1 is an isometric view of an exemplary ladder-mounted equipment holding assembly and method for operating a ladder-mounted equipment holding assembly attached to a ladder, in accordance with an embodiment of the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read together with the specification, and are to be considered a portion of the entire written description of this invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 2:
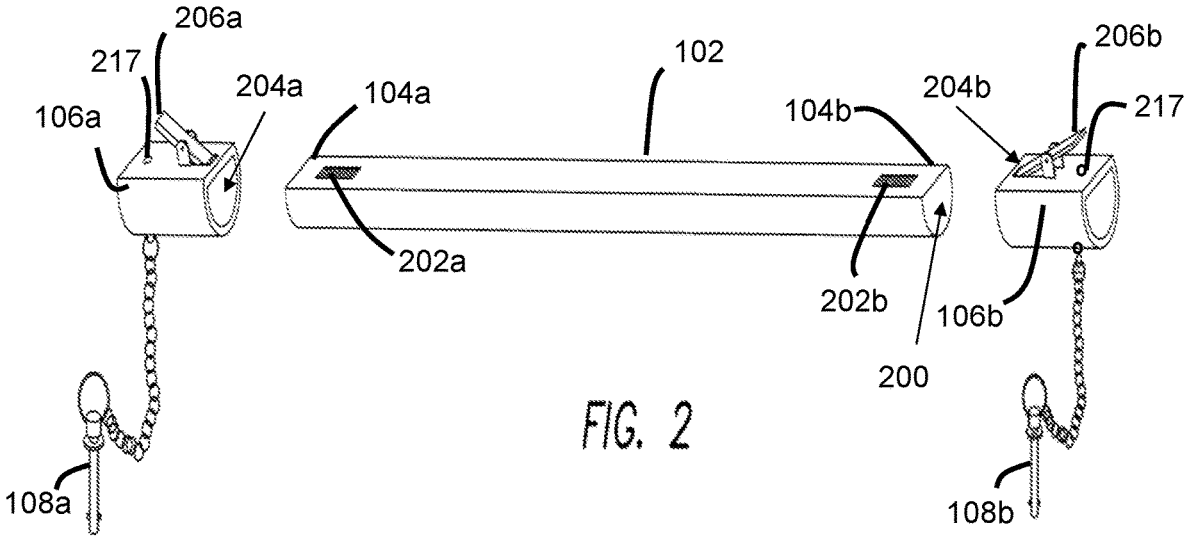
FIG. 2 is a perspective view of an exemplary mount sleeve and a pair of caps, in accordance with an embodiment of the present invention.

Referring now to the drawings, FIGS. 1-2 illustrate a ladder-mounted equipment holding assembly 100 and method 1300 of operation. The ladder-mounted equipment holding assembly 100, hereafter "assembly 100" provides an elongated mount sleeve 102 that is configured to slidably fit through the holes in the sides of a ladder 110, and slide into a corresponding rung in the ladder 110. A pair of caps 106*a* serve to centrally fasten the mount sleeve 102 to the rung via a clip mechanism. In a variant, the clip mechanism comprises a clip and a track. The caps 106*a* have biased levers 206*a*, 206*b*, for example, alligator clips that have rectangular teeth, that align with corresponding teeth on tracks 202*a*, 202*b* formed in the mount sleeve 102. The clips 206*a*, 206*b* couples the caps 106*a*, 106*b* to free ends 104*a-b* of the mount sleeve 102 end. Furthermore, multiple interchangeable equipment anchoring accessories 600, 700, 800, 900, 1000, 1100, 1200 detachably attach to the free ends 104*a-b* of the mount sleeve 102 when a cap 106*a* or 106*b* (or both) is attached. The anchoring accessories comprise various shapes and dimensions, such as threaded pipes, hooks, rings, and clips. The anchoring accessories serve to hold equipment and tools in an accessible position for a user working on the ladder 110. For example, the equipment may include a paint bucket, a paint brush, a roller, and other tools pertinent to operations on ladder 110.

The assembly 100 is operable with a ladder 110 to hold equipment that is commonly used by ladder operators, in a proximal, accessible position at any of the rungs 118*a-h* along the ladder 110. In one non-limiting embodiment, the ladder 110 comprises an upper region 112 and a lower region 114. The ladder 110 includes two parallel legs 116*a*, 116*b* defined by spaced-apart holes form along the length of the legs 116*a*, 116*b*. Multiple rungs 118*a-h* are aligned with the spaced-apart holes formed in the legs 116*a-b*. The rungs 118*a-h* are disposed in a perpendicular arrangement relative to the legs 116*a*, 116*b*. The assembly holds equipment near the ends of the rungs, along the legs 116*a-b* of the ladder 110.

As referenced in FIG. 2, the assembly 100 provides at least one mount sleeve 102 that detachably joins with the ladder 110, and specifically one of the rungs 118*a-h* of the ladder 110. The mount sleeve 102 can join with any one of the rungs 118*b* that traverse the legs 116*a-b*. The mount sleeve 102 has a flat side and a curved side to match the cross section of the ladder rung. By allowing the mount sleeve 102 to selectively join with any of the rungs 118*a-h*, the equipment can be selectively accessed from multiple heights along the ladder 110.

In some embodiments, the mount sleeve 102 is defined by a channel 200 that slides into the rungs 118*a-h*. In one possible embodiment, the channel 200 is threaded from either free end 104*a*, 104*b* of the mount sleeve 102. In one non-limiting embodiment, the threaded channel 200 may include a male thread that rotatably couples with a female thread of an equipment anchoring accessory, as described below.

The mount sleeve 102 also includes a pair of free ends 104*a-b*, extending out from the ends of the corresponding rungs 118*a-h*. Thus, the mount sleeve is dimensioned longer than the width of the ladder. The other components of the assembly 100 attach to the free ends 104*a-b* of the mount sleeve 102. In one non-limiting embodiment, the mount sleeve 102 is elongated, and has a cylindrical, or a half cylinder shape. Suitable materials for the mount sleeve 102 may include, without limitation, a rigid plastic, polyurethane, polyethylene, polyvinyl chloride, aluminum, wood, and rubber.

Furthermore, as FIG. 2 illustrates, tracks 202*a*, 202*b* are formed near ends of the sleeve 102 where caps 106*a*, 106*b* can clip onto. Caps 106*a*, 106*b* have pin passageways 217 that are sized and dimensioned to enable passage of a locking pin 108*a-b*, as described below. In one non-limiting embodiment, a right free end 104*b* of the mount sleeve 102 has a track 202*a-n* than a left free end 104*a* of the mount sleeve 102. The length of tracks 202*a-b* near the ends 104*a-b* of the sleeve 202 allows the caps 106*a-b* to slide as needed, to length-adjust for various width ladders.

Figure 3:
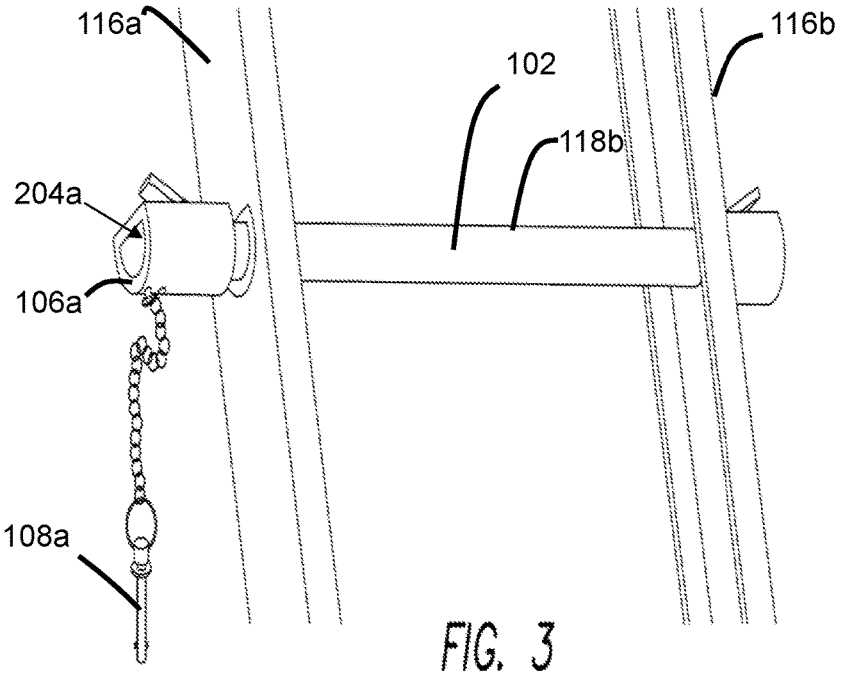
FIG. 3 is a perspective view of the mount sleeve and pair of caps shown in FIG. 2, coupled to a rung of a ladder, in accordance with an embodiment of the present invention.

Referring to FIG. 3, the assembly 100 provides a pair of caps 106*a*, 106*b* that detachably fit at the free ends 104*a-b* of the mount sleeve 102. The caps 106*a* are configured to cover the free ends 104*a-b* of the mount sleeve 102, which extend past ends of the rungs 118*a-h*. In one embodiment, the caps 106*a* comprise an open end and an opposing closed or sealed or covered end. A cavity 204*a-b* is formed between the ends of the cap 106*a-b* to enable entry of the free ends 104*a-b* of the mount sleeve 102. Receiving the free ends 104*a-b* of the mount sleeve 102, the cavity 204*a-b* is sized to slidably receive the free ends 104*a-b*, fitting the cap to the free ends 104*a-b* of the mount sleeve 102.

Figure 18:
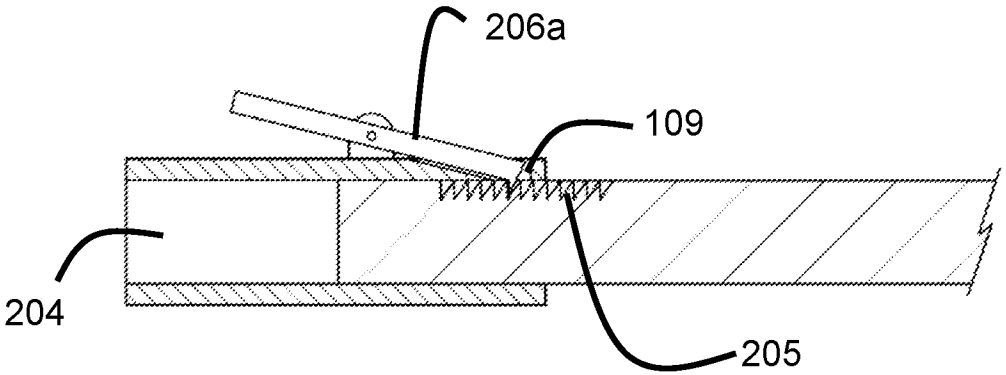
FIG. 18 is a cross section view of a mount sleeve and end cap connection.

Referring to FIG. 18, which illustrates a cross section view, the caps have a hole 109 that allows the clip 206*a-b* to penetrate through the cap into the cavity 204*a-b*. When a cap 206*a-b* receives the mount sleeve 102, the track on the sleeve ratchets along the cap, engaging the clip via track teeth 205 until the desired position is reached. In one non-limiting embodiment, the caps 106*a* are defined by a half cylinder shape to match the shape of the sleeve and ladder rung. Other cross section shapes are suitable.

Figure 4:
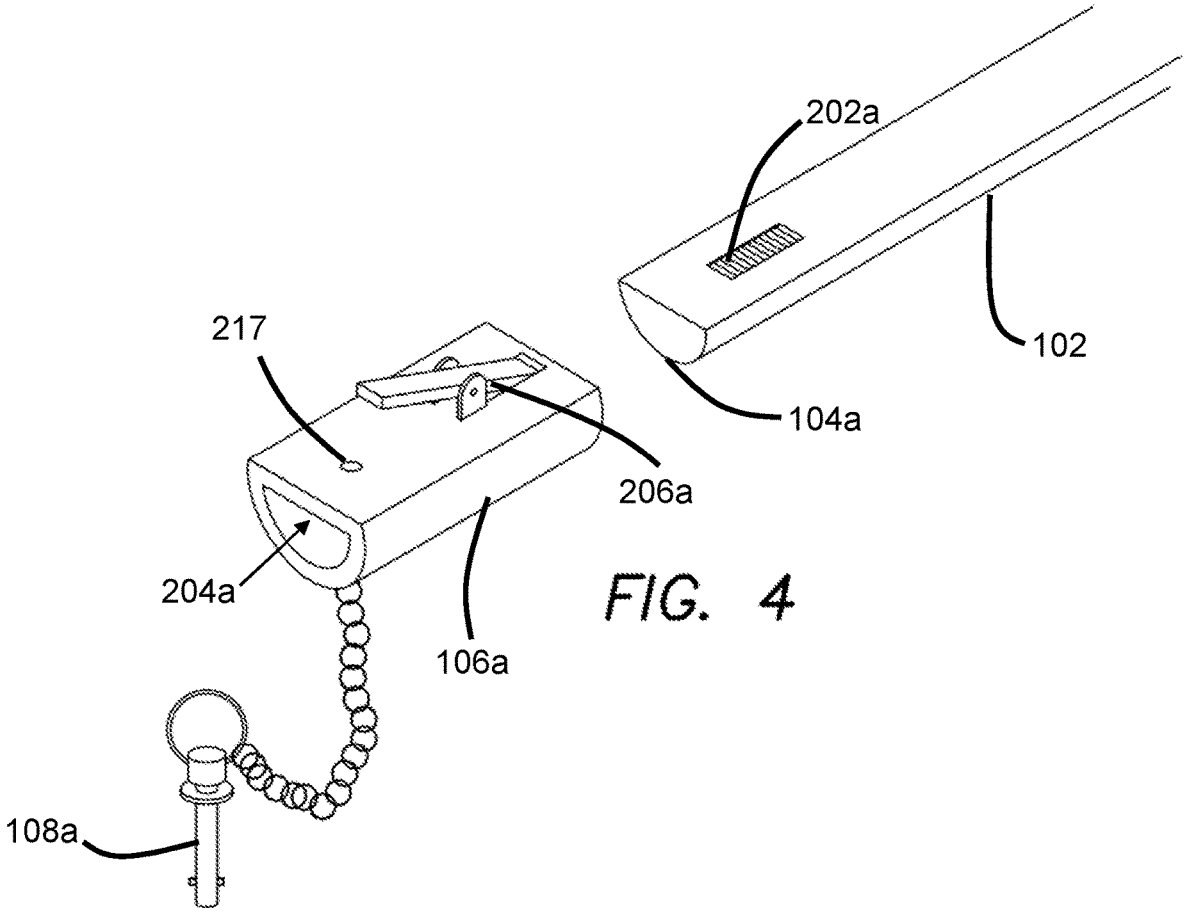
FIG. 4 is a close up view of the caps and an exemplary locking pin detached from the mount sleeve, in accordance with an embodiment of the present invention.
Figure 5:
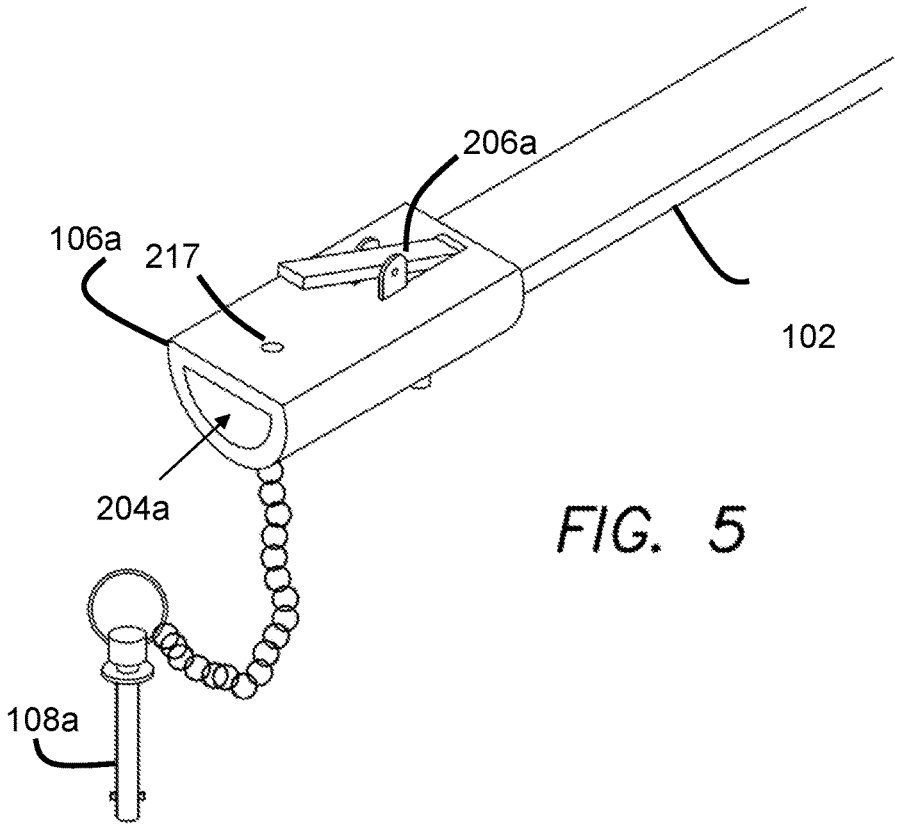
FIG. 5 is a close up view of the caps and an exemplary locking pin, showing the locking pin fastening the caps to the mount sleeve, in accordance with an embodiment of the present invention.

FIGS. 4-5 illustrate, the assembly 100 with caps inserted onto the sleep and also caps disengaged from the sleeve. The assembly 100 utilizes a clip and track that works to fasten the caps 106*a* to the free ends 104*a-b* of the mount sleeve 102. Once a cap is inserted onto the sleeve, it may be released by pressing on the lever arm of the clip to disengage the clip from the track.

As discussed above, the assembly 100 is unique in that equipment, related to operations on a ladder 110, are detachably attachable along the length of the ladder 110. The assembly 100 provides multiple interchangeable equipment anchoring accessories that are detachably attachable to one of the free ends 104*a-b* of the mount sleeve 102. However, the equipment anchoring accessories are also attachable to the caps 106*a* when fitted to the mount sleeve 102. The interchangeable equipment anchoring accessories may also secure to the caps 106*a* while coupled to the mount sleeve 102. In any case, the equipment anchoring accessories allow equipment to be detachably attached, and easily accessible while working on the ladder 110.

Figure 6:
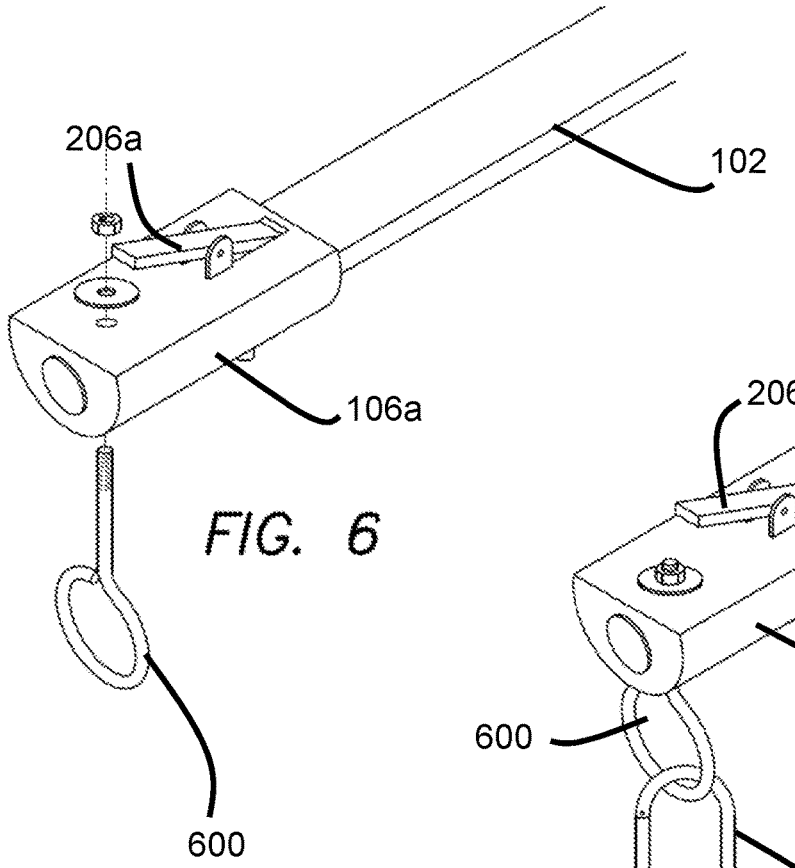
FIG. 6 is a perspective view of an exemplary anchoring accessory, such as a pull ring, in accordance with an embodiment of the present invention.

Referring to FIGS. 6-9, each unique shape of equipment anchoring accessory is designed to hold a corresponding equipment. The equipment includes a tool, container, etc., that is used in conjunction with operations of a ladder 110. In one example, the anchoring accessory is a ring 600. The ring 600 has a circular member defined by an annular surface area for hanging equipment, and an extending pole that passes through the pin hole and the pin passageway to fasten the ring 600 to the mount sleeve 102. Various nuts, bolts, and washers can be used to hold the ring to the free end of the mount sleeve 102. Different types of equipment may be hung onto the ring for easy access thereof near the legs 116*a*, 116*b* of the ladder 110 (FIG. 6).

Figure 7:
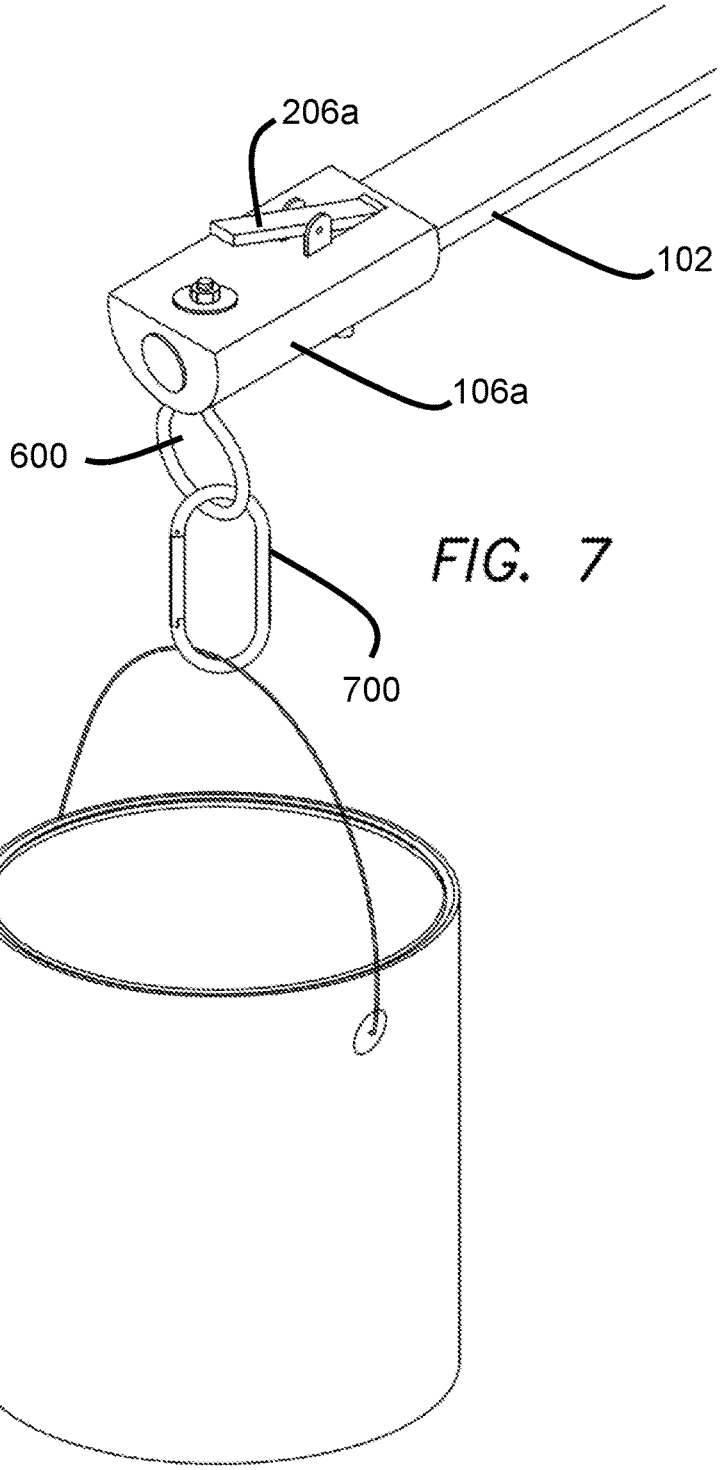
FIG. 7 is a perspective view of an exemplary anchoring accessory, such as a spring-loaded clip holding a paint bucket, in accordance with an embodiment of the present invention.
Figure 8:
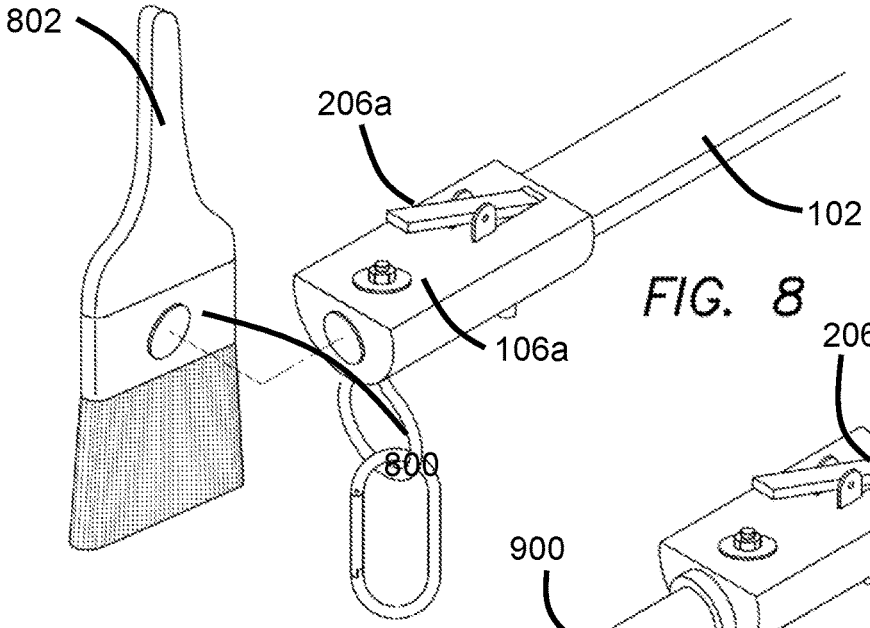
FIG. 8 is a perspective view of an exemplary anchoring accessory, such as a magnet holding a paint brush, in accordance with an embodiment of the present invention.

In another embodiment shown in FIG. 7, the anchoring accessory is a spring-loaded clip 700, allowing for easy ingress/egress for equipment to hang on the clip 700. For example, a paint bucket 702 can hand by a handle from the clip. However, other types of equipment may also be hung from the clip 700 in similar fashion. In yet another embodiment, the clip 700, itself, hangs from the ring 600. Turning now to the illustration in FIG. 8, the anchoring accessory may include a magnet 800 fitted to the end of the mount sleeve 102. In this example, the magnet 800 is configured to retain a paint brush 802; whereby the paint brush has a corresponding magnet integrated therein. In another embodiment, the magnet 800 connects to a magnet on a male screw-on adapter. The adapter accepts a weenie roller. This attachment may also comprises a material strap that is configured to attach to a human wrist.

Figure 9:
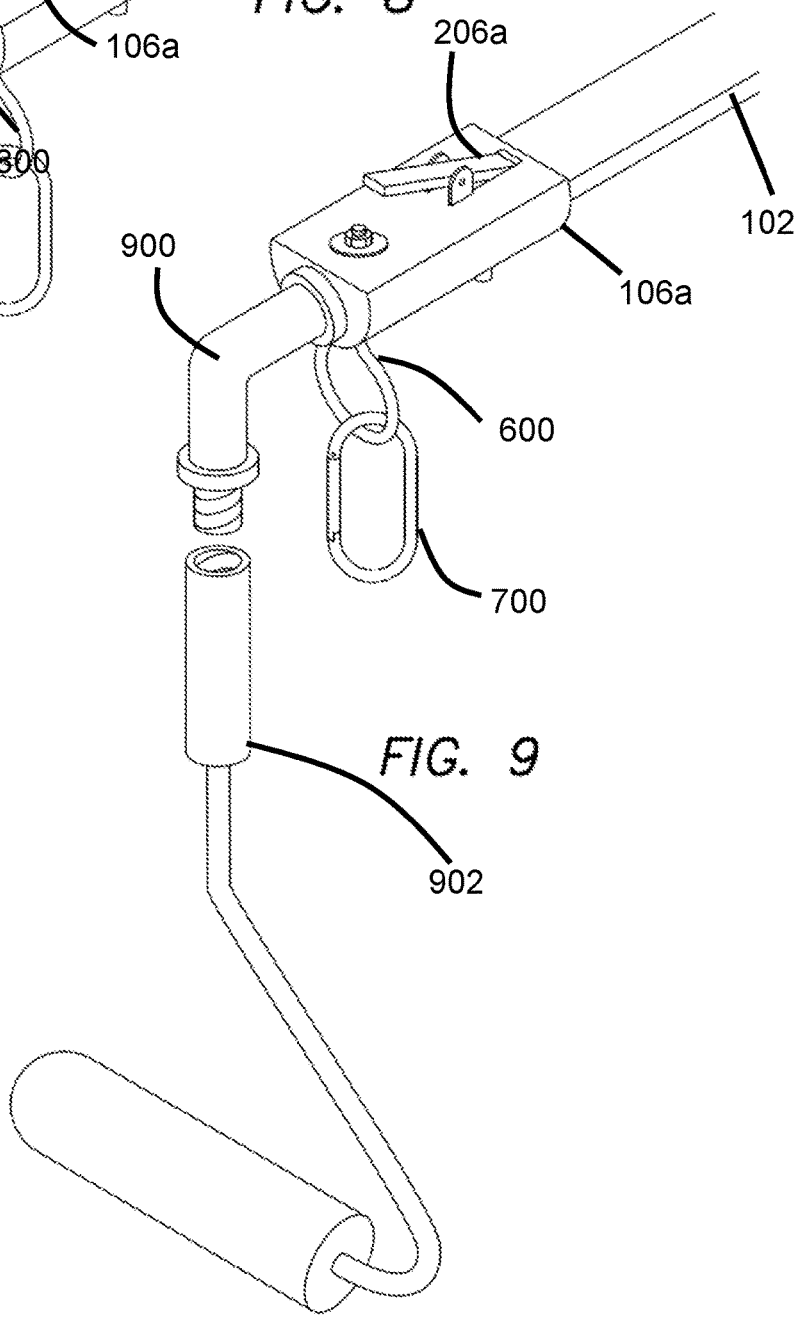
FIG. 9 is a perspective view of an exemplary anchoring accessory, such as an L-shaped pipe, in accordance with an embodiment of the present invention.
Figure 10:
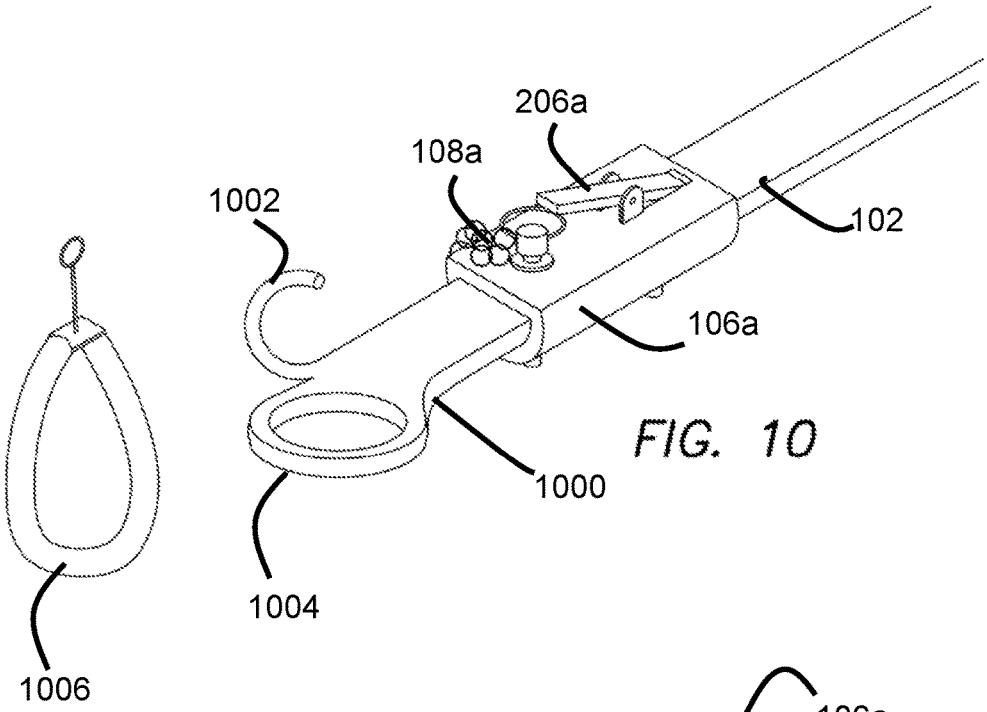
FIG. 10 is a perspective view of an exemplary anchoring accessory, such as a flange with hook and ring, in accordance with an embodiment of the present invention.

Another unique anchoring accessory is a pipe with a 90 degree bend (L-shaped) 900 having a threaded free end (See FIG. 9). A correlating equipment with threaded end, such as a handle of a paint roller 902 can attach thereto. Continuing with the anchoring accessories, FIG. 10 shows a unique anchoring accessory comprising a flange 1000 that terminates at a hook 1002 and a ring 1004. The hook 1002 and/or ring 1004 is configured to support a support band 1006, bucket, or other types of equipment.

Figure 11:
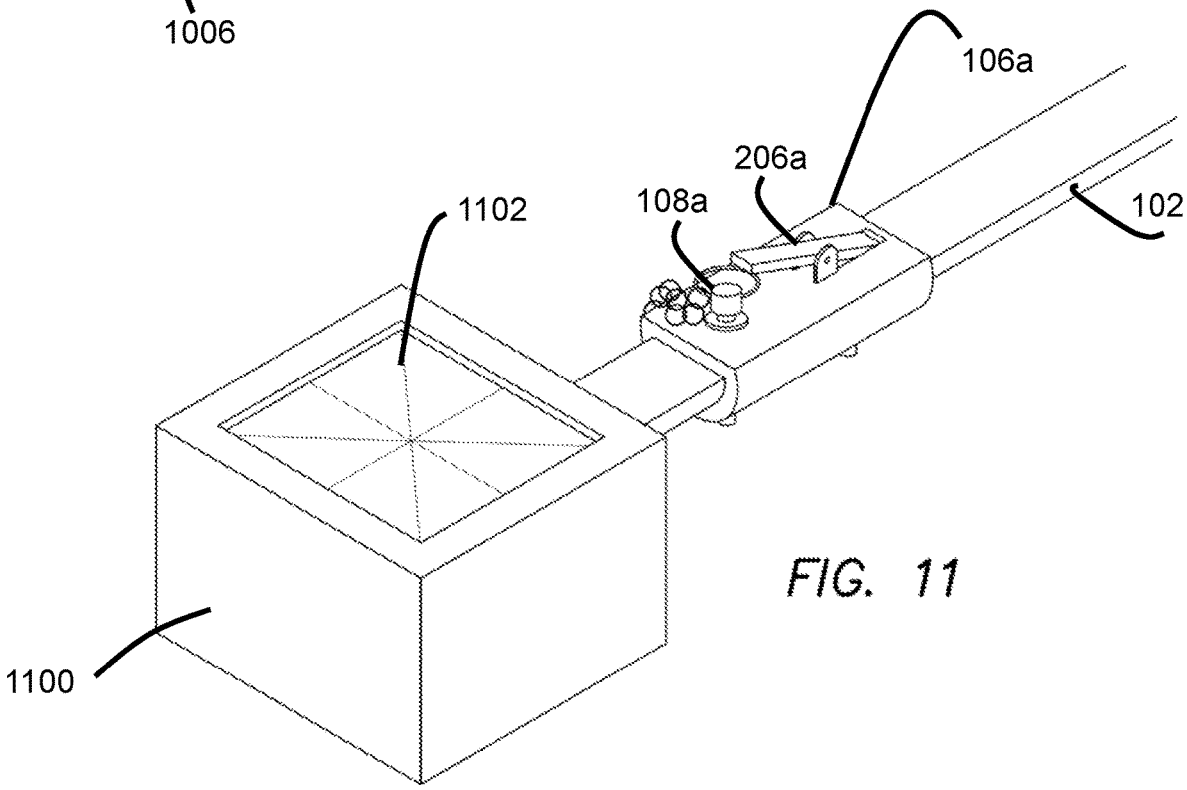
FIG. 11 is a perspective view of an exemplary anchoring accessory, such as a cube, in accordance with an embodiment of the present invention.
Figure 12:
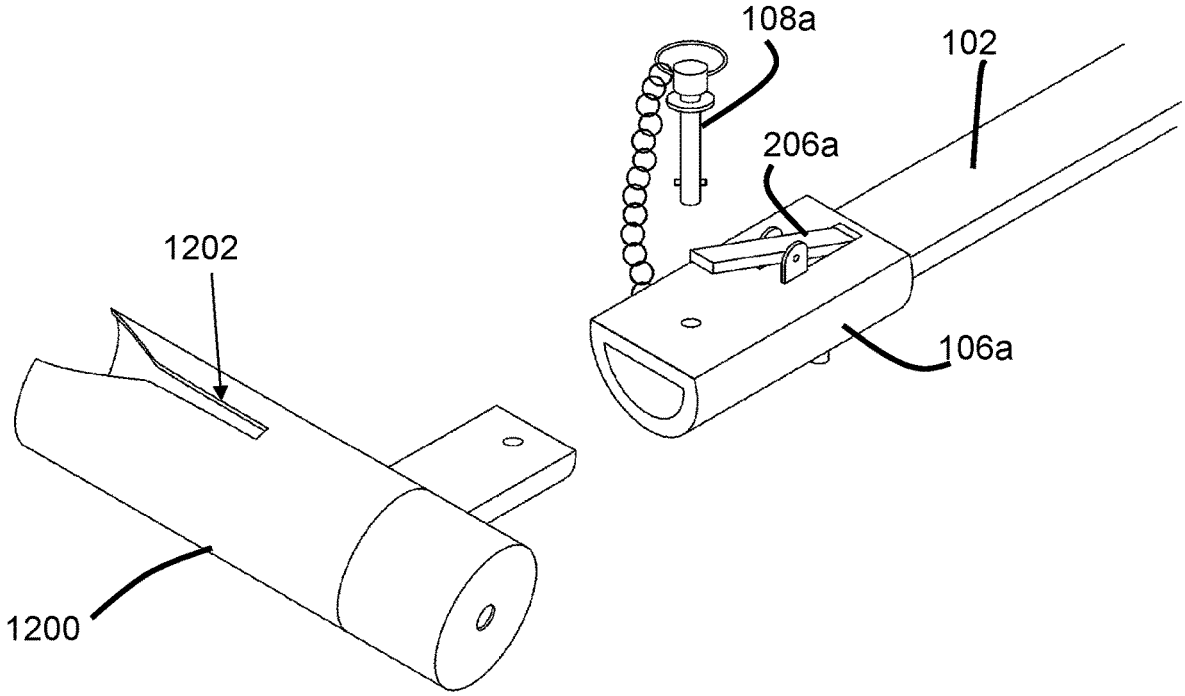
FIG. 12 is a perspective view of an exemplary anchoring accessory, such as a cylinder with slot, in accordance with an embodiment of the present invention.

Turning now to FIG. 11, the anchoring accessory is a tray for storing nails, screws, or similar objects 1100 having a support pad 1102. The support pad 1102 can be used as a flat surface for supporting equipment. And as FIG. 12 illustrates, the anchoring accessory comprises a cylinder 1200 defined by a slot 1202. The cylinder 1200 is configured to receive a holster that can hold multiple caulking tubes, paper rolls, and various lengths of plastic rolls. An empty tube can also be replaced while a user grabs a new one in the caulking holster. In yet another embodiment, a caulk holster, or other similar equipment may be fitted into the cylinder, with the lever passing through the slot 1202.

In other embodiments, the equipment may include, without limitation, a drill, tool, hammer, a scraper holder, a paint bucket, a caulk holster, a paint roller, a paper roll, a paint sprayer, a magnetic brush holder, and a window-washing bucket. In any case, the equipment is attached at the ends of the rungs 118*a-h*, and at a desired height along the ladder 110 for facilitated access. Also, the attachability of the equipment to the anchoring accessory is sufficiently easy to enable quick detachment for use of the equipment.

Figure 14:
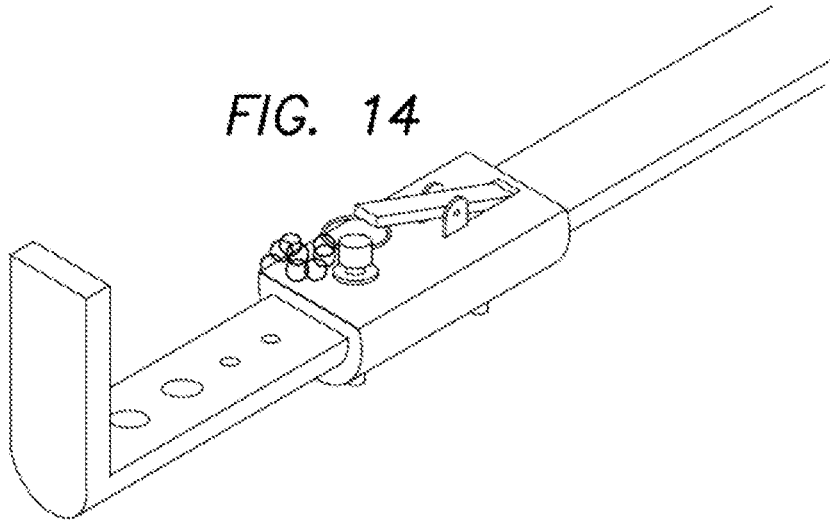
FIGS. 14-17 are perspective views of exemplary anchoring accessories.
Figure 15:
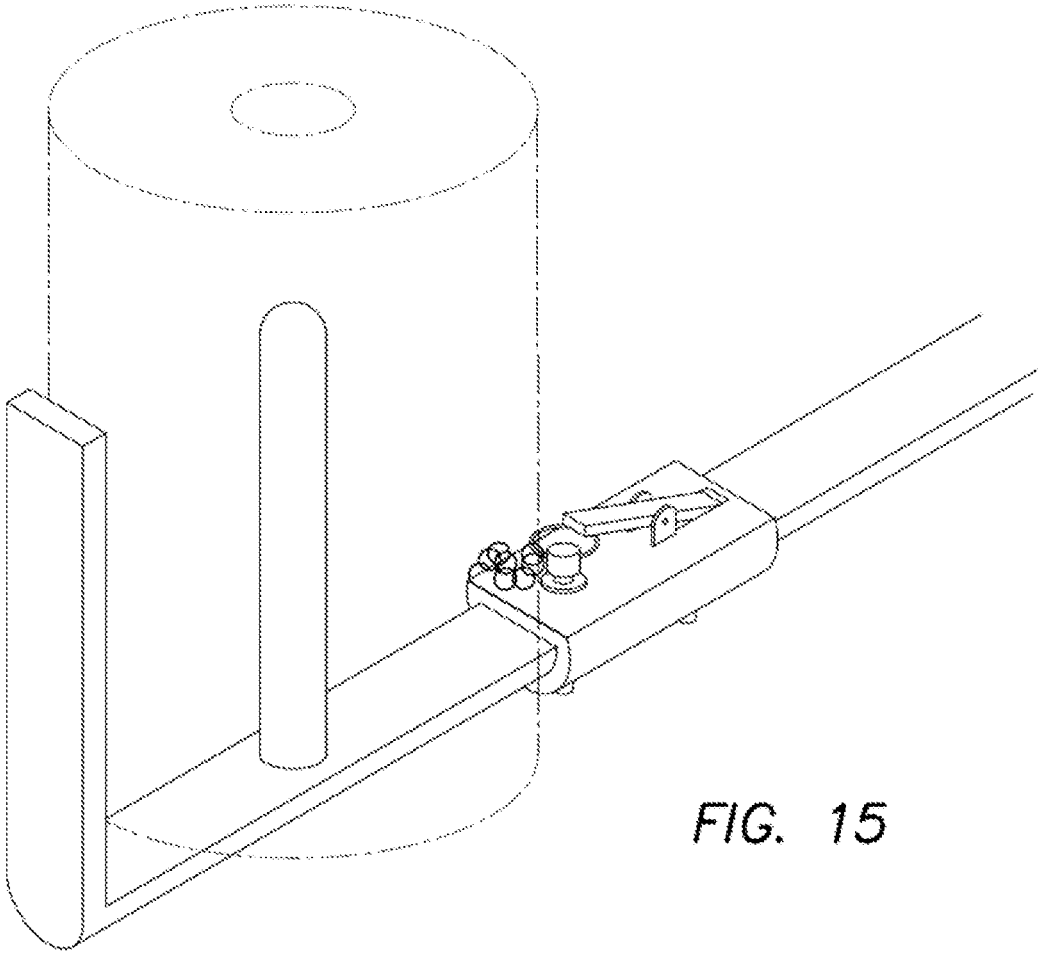
Figure 16:
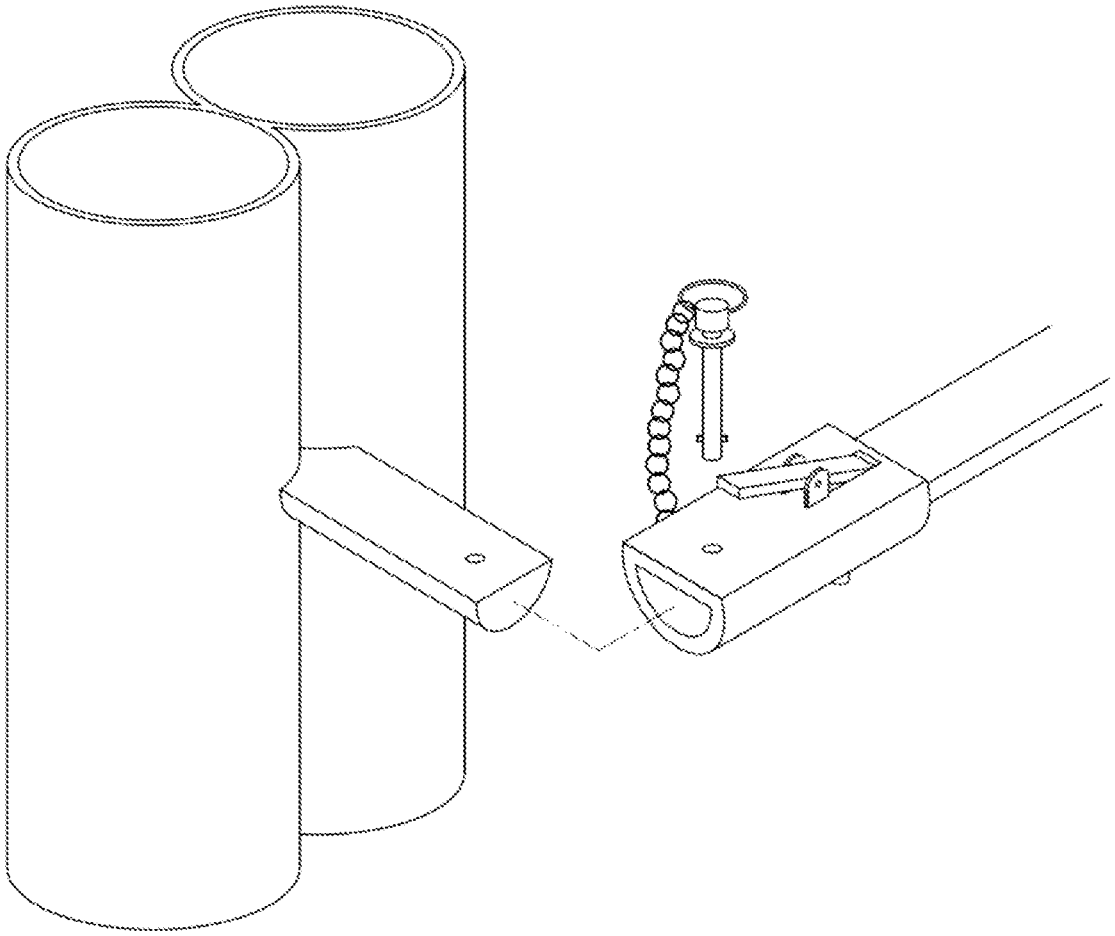
Figure 17:
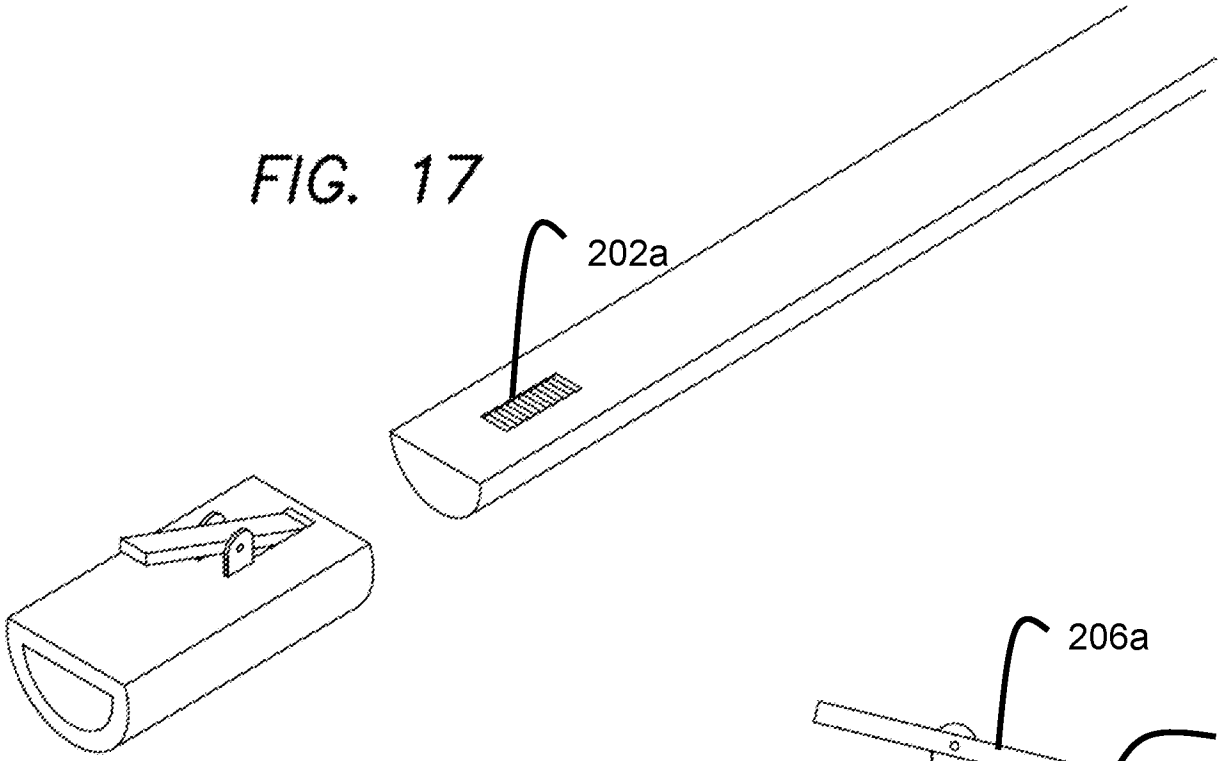
Figure 19:
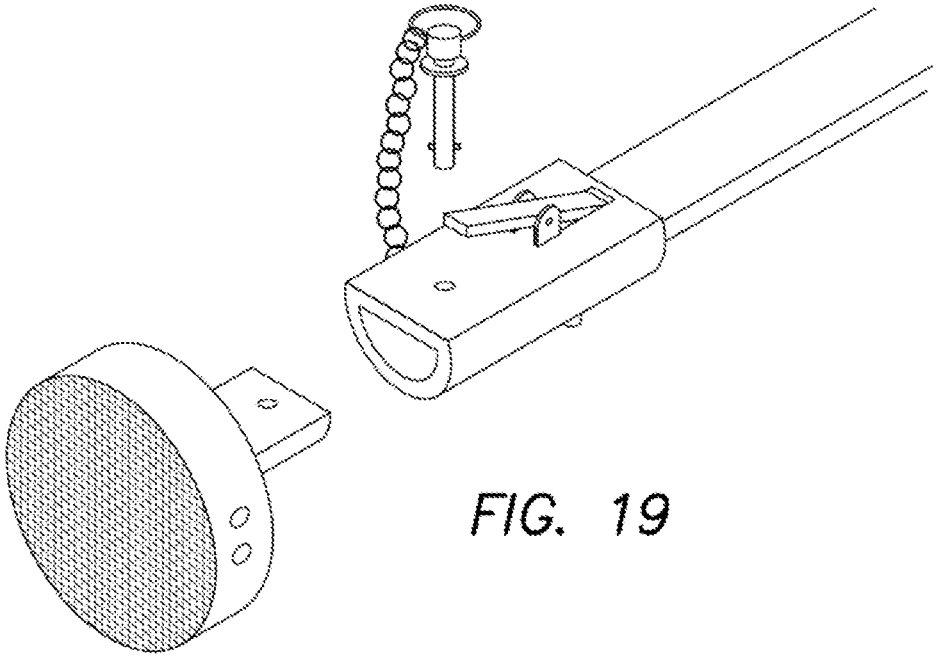
FIG. 19 is a perspective view of an exemplary anchoring accessory comprising a speaker.

FIG. 14 illustrates an anchoring accessory comprising L shaped member with holes for hanging various objects therefrom. The anchoring accessory is configured to be received into the cap and locks into place via pin and passageway. FIG. 15 illustrates an anchoring accessory comprising a roll dispenser. FIG. 16 illustrates an anchoring assembly two cylindrical slots for holding, for example, caulking tubes. FIG. 17 illustrates the cap disengaged from the sleeve. FIG. 19 illustrates an anchoring accessory is a blue tooth speaker that can connect to a user's phone to play music or phone calls. The speaker connects to the cap via an end connection that is sized and shaped to be received into the cap and locked into place via a pin passageway and pin connection.

Figure 20:
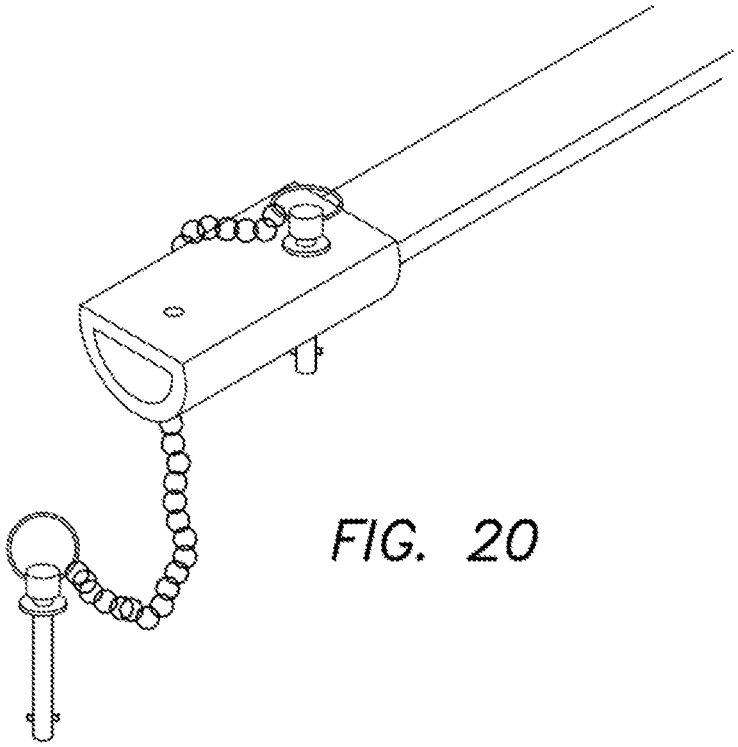
FIG. 20 is an alternative embodiment of the cap and sleeve connection comprising a pin and passageway system.

In a variant, FIG. 20 illustrates a cap with two pin passageways and two pins, one for connection to the sleeve which also has pin passageways to connect with the cap via a pin. The second pin on the cap is for connection to an anchoring accessory.

Figure 13:
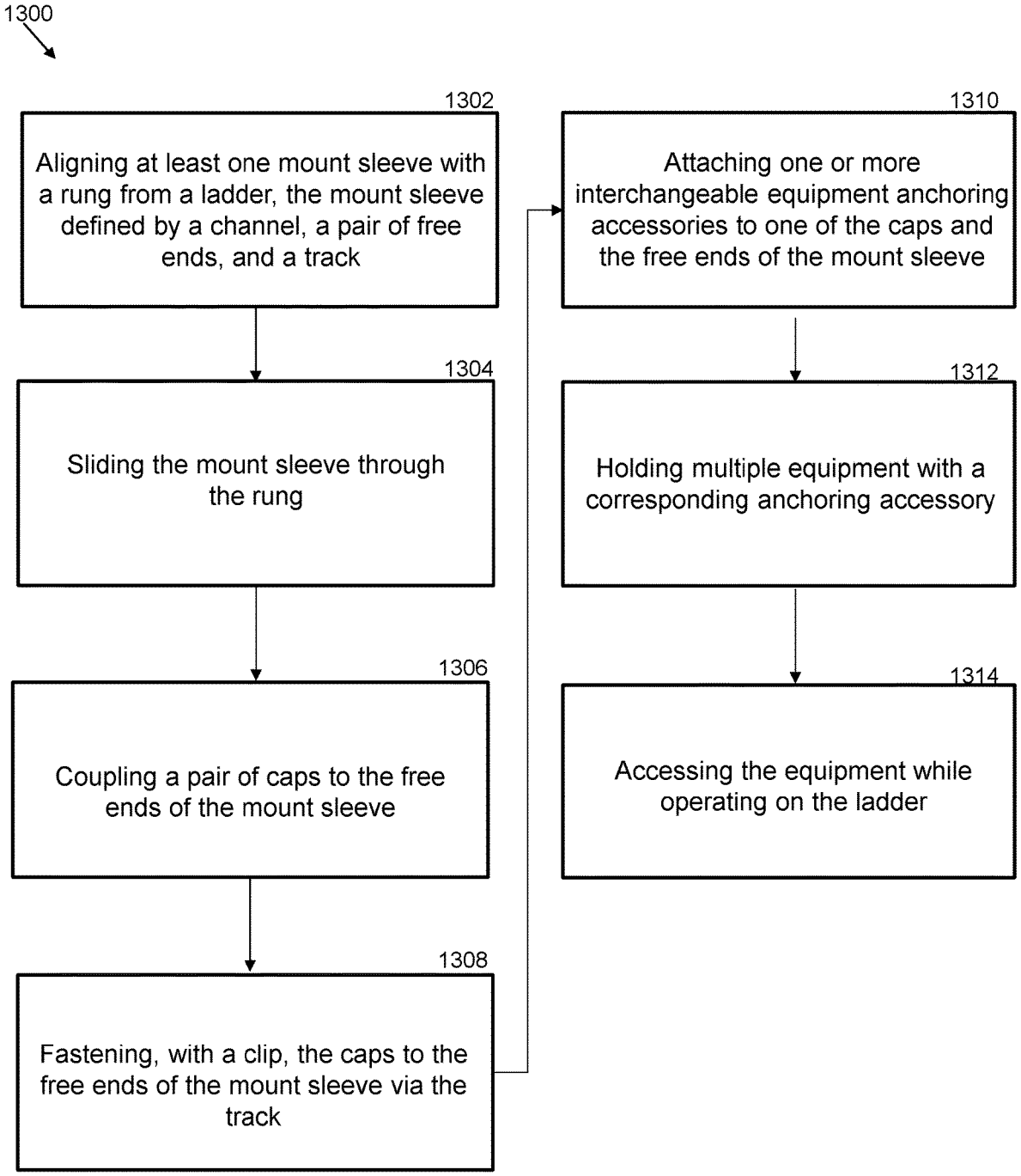
FIG. 13 is a flowchart diagram of an exemplary method for operating a ladder-mounted equipment holding assembly, in accordance with an embodiment of the present invention.

FIG. 13 illustrates a flowchart diagram of an exemplary method 1300 for operating a ladder-mounted equipment holding assembly. The method 1300 allows the ladder-mounted equipment holding assembly 100 to hold equipment along the length of the ladder 110 for easy access. The method 1300 may include an initial Step 1302 of aligning at least one mount sleeve with a rung from a ladder, the mount sleeve defined by a channel, a pair of free ends, and locking mechanism. The method may further comprise a Step 1304 of sliding the mount sleeve through the rung.

In some embodiments, a Step 1306 includes coupling a pair of caps to the free ends of the mount sleeve. The pair of caps 106*a*, 106*b* detachably fit at the free ends 104*a-b* of the mount sleeve 102. The caps 106*a* are configured to cover the free ends 104*a-b* of the mount sleeve 102, and also cover the ends of the rungs 118*a-h*. In other embodiments, a Step 1308 comprises fastening, with a locking pin, the caps to the free ends of the mount sleeve. In fastening operations, the locking pin 108*a-c* passes through the aligned holes. As illustrated in FIG. 5, the locking pin 108*a* is axially displaced through the pin hole and pin passageway.

A Step 1310 includes attaching one or more interchangeable equipment anchoring accessories to one of the caps and the free ends of the mount sleeve. The interchangeable equipment anchoring accessories may secure to the caps 106*a* while coupled to the mount sleeve 102. In any case, the equipment anchoring accessories allow equipment to be detachably attached, and easily accessible while working on the ladder 110. In some embodiments, the method 1300 may include a Step 1312 of holding multiple equipment with a corresponding anchoring accessory. Each unique shape of equipment anchoring accessory is designed to hold a corresponding equipment. A final Step 1314 includes accessing the equipment while operating on the ladder. The proximity of the equipment to the ends of the rungs facilitates this access.

Referring to FIG. 20, a variant of the ladder-mounted equipment holding assembly provides an elongated mount sleeve that is configured to slidably fit through the holes in the sides of a ladder, and slide into a corresponding rung in the ladder. A pair of caps serve to centrally fasten the mount sleeve to the rung. In a variant, the caps have a pin hole that aligns with corresponding pin passageways formed in the mount sleeve. At least one locking pin couples the caps to the mount sleeve ends. Furthermore, multiple interchangeable equipment anchoring accessories 600, 700, 800, 900, 1000, 1100, 1200 detachably attach to caps via pin and passageways in the accessories. The anchoring accessories comprise eclectic shapes and dimensions, such as threaded pipes, hooks, rings, and clips. The anchoring accessories serve to hold a corresponding equipment in an accessible position for a user working on the ladder 110. The equipment may include a paint bucket, a paint brush, a roller, and other tools pertinent to operations on ladder 110.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence The present invention contemplates that many changes and modifications may be made. Therefore, while the presently-preferred form of the system has been shown and described, and several modifications and alternatives discussed, persons skilled in this art will readily appreciate that various additional changes and modifications may be made without departing from the spirit of the invention, as defined and differentiated by the following claims.

What is claimed is:

1. A ladder-mounted equipment holding assembly, the assembly being attachable to a ladder which comprises an upper region and a lower region, two parallel legs defined by spaced-apart holes formed along the length of the legs, and multiple rungs aligned with the spaced-apart holes, the rungs disposed in a perpendicular arrangement relative to the legs, the assembly comprising:

at least one elongated mount sleeve defined by a channel, a pair of free ends, and a track disposed near an end of the mount sleeve;

at least one cap having a biased lever, the cap having a hole through which the lever penetrates and engages the track, the cap having a cavity, the cap adapted to slidably fit to the free ends of the mount sleeve, the cap having a locking mechanism;

multiple interchangeable equipment anchoring accessories, each anchoring accessory being detachably attachable to one of the free ends of the mount sleeve via the locking mechanism; and wherein the mount sleeve is configured to slide into at least one rung of the ladder via a spaced-apart hole on one of the legs of the ladder;

wherein the biased lever comprises teeth that mate with corresponding teeth in the track of the mount sleeve.

2. The assembly of claim 1, wherein the channel at the free ends of the mount sleeve is threaded.

3. The assembly of claim 1, wherein the at least one cap has a cross section with a perimeter comprising a curved side and a flat side.

4. The assembly of claim 1, wherein the cavity of the at least one cap is configured to slidably receive the free ends of the mount sleeve.

5. The assembly of claim 1, wherein the locking mechanism comprises a locking pin.

6. The assembly of claim 5, wherein at least one anchoring accessory is detachably attachable to one of the at least one cap, via a pin passageway configured to receive the locking pin.

7. The assembly of claim 1, wherein the anchoring accessories include at least one of the following: a spring-loaded clip, a ring, a magnet, a cube, and an L-shaped pipe having a threaded free end.

8. The assembly of claim 1, wherein the anchoring accessories comprise a flange terminating at a hook and a ring.

9. The assembly of claim 1, wherein the anchoring accessories comprise a cylinder defined by a slot.

10. The assembly of claim 1, wherein the anchoring accessories are operable to hold multiple equipment.

11. The assembly of claim 1, wherein the equipment includes at least one of the following: a drill, tool, hammer, a scraper holder, a paint bucket, a caulk holster, a paint roller, a paper roll, a paint sprayer, a magnetic brush holder, and a window-washing bucket.

12. A ladder-mounted equipment holding assembly, the assembly being attachable to a ladder which comprises an upper region and a lower region, two parallel legs defined by spaced-apart holes formed along the length of the legs, and multiple rungs aligned with the spaced-apart holes, the rungs disposed in a perpendicular arrangement relative to the legs, the assembly comprising:

at least one elongated mount sleeve defined by a channel, a pair of free ends, and a track disposed near an end of the mount sleeve;

at least one cap having a biased lever, the cap having a hole through which the lever penetrates and engages the track, the cap having a cavity, the cap adapted to slidably fit to the free ends of the mount sleeve, the cap having a locking mechanism;

multiple interchangeable equipment anchoring accessories, each anchoring accessory being detachably attachable to one of the free ends of the mount sleeve via the locking mechanism; and wherein the mount sleeve is configured to slide into at least one rung of the ladder via a spaced-apart hole on one of the legs of the ladder;

wherein the cap is configured to slide onto the sleeve in one continuous movement via a ratcheting of the biased lever over the track.

* * * * *